US006460762B1

(12) United States Patent
Bromberg et al.

(10) Patent No.: US 6,460,762 B1
(45) Date of Patent: Oct. 8, 2002

(54) WHEEL CALCULATOR

(76) Inventors: Ronald Bromberg, 2675 Henry Hudson Pkwy., Bronx, NY (US) 10463-7737; Anthony Wilson, One Miller Close, Godmanchester Cambs PE 188YN (GB)

( * ) Notice: Subject to any disclaimer, the term of this patent is extended or adjusted under 35 U.S.C. 154(b) by 0 days.

(21) Appl. No.: 09/364,428

(22) Filed: Jul. 30, 1999

(51) Int. Cl.[7] ..... G06C 27/00
(52) U.S. Cl. ..... 235/78 R; 235/487
(58) Field of Search ..... 235/78 R, 77, 235/487, 491, 493, 495; 369/281; 360/98.08, 99.12

(56) References Cited

U.S. PATENT DOCUMENTS 3,778,766 A * 12/1973 Rapp ..... 340/146.1 AJ
4,680,453 A * 7/1987 Pugh ..... 235/88 R
4,754,125 A * 6/1988 Penn ..... 235/88 R
5,470,627 A * 11/1995 Lee et al. ..... 428/64.4
5,678,862 A * 10/1997 Hughes et al. ..... 283/65
5,875,171 A * 2/1999 Albrecht et al. ..... 369/281

* cited by examiner

*Primary Examiner*—Karl D. Frech
(74) *Attorney, Agent, or Firm*—Herbert Dubno

(57) ABSTRACT

A wheel chart having at least one rigid disk formed by a compact disk which, in addition to having a mirrored or reflective layer capable of carrying reproducible information, has legible matter on an obverse side which cooperates with a member such as a transparent rigid disk which can also bear indicia to enable calculations to be made by relative rotation of the disks.

6 Claims, 4 Drawing Sheets

WHEEL CALCULATOR

FIELD OF THE INVENTION

The present invention relates to a wheel calculator and, more particularly, to a wheel calculator in which at least one of the relatively rotatable members is a compact disk or at least the circular body or blank of a compact disk.

BACKGROUND OF THE INVENTION

Wheel calculators have been provided heretofore in a wide variety of configurations and for many different purposes. For example, a circular slide rule may combine a disk with a cursor on a member rotatable relative to the disk and circular slide rules may have several disks, a window arrangement and various index markings enabling calculations to be made based upon indicia on the disks or the relatively rotatable members. Less sophisticated wheel calculators may include an information carrying wheel rotatable beneath or between other disk shaped members or cover structures which may be provided with windows or clear areas or openings through which information on the disk can be read. Wheel calculators may be used to forecast events, as calendars, as calculators for taxes, fees, rebates or the like, and as devices facilitating the selection of a particular condition. They may be free to hold in the hand, or permanently affixed into, say, a book, and may be themselves promotional materials or may be incorporated in promotional materials. In practically all cases in which a wheel has been a rigid member in earlier systems, that wheel was specifically designed for the calculator, generally had a considerable thickness, and was especially fabricated and hence of comparatively high cost.

Where the wheel was composed of a nonrigid material, e.g. paper or cardboard, it could be effectively die cut from a web or sheet of such material and provided with a central perforation or die cut to accommodate the member forming a journal for that wheel, i.e. a member enabling rotation of the wheel relative to something else.

Flexible wheels of this type were prone to damage and were easily distorted not only by misuse but even in regular or careful use.

OBJECTS OF THE INVENTION

It is the principal object of the present invention to provide an improved wheel calculator which avoids drawbacks of earlier wheel calculators.

Another object of this invention is to provide a wheel calculator less prone to damage then earlier wheel calculators, which is inexpensive to manufacture and is both aesthetically pleasing and satisfying to use.

SUMMARY OF THE INVENTION

These objects and others which will become apparent hereinafter are attained, in accordance with the invention, in a wheel calculator, wheel chart or wheel display device comprising at least one disk, at least one member cooperating with the disk and enabling information carried by the disk to be indexed or displayed and means for mounting the disk and member so that they are relatively rotatable about an axis of the disk whereby different information on the disk can register with the member. According to the invention, the disk is a compact disk or CD-ROM or DVD or a disk body or blank free from data, information, music or images, and the journal between the member and the compact disk is formed by the conventional hole provided in the compact disk.

When reference is made herein to a compact disk body, I intend thereby to describe a circular disk which generally has a diameter of less than 15 cm and preferably at most 12 cm with a hub portion generally of a diameter less than 4 cm and preferably of approximately 3.5 cm with a circular hole which can be of a diameter of less than 2 cm and preferably about 1.8 cm, formed unitarily of a transparent resin material. To at least one surface of this body or blank a mirror coating (metallization) is customarily applied around the hub so that a compact disk is formed.

The compact disk can carry digital information beyond the legible information imprinted thereon and with which the member cooperates. For example, the compact disk may be a CD-ROM, a compact disk containing musical selections or audio information and readable in the disk reader of a computer or adapted to be played in a CD player. It can carry visually reproducible information, for example, sequences of still photographs, motion pictures and the like. In the broadest case, however, the only information required to be on that compact disk is the legible information which is selected by the aforementioned member.

According to another feature of the invention that other member is, in turn, a rigid disk having at least a portion through which information on the first mentioned compact disk is visible.

In a preferred embodiment, the rigid disk is a synthetic resin transparent disk, similar to that of a compact disk, but not provided with the mirror-like information carrier coating of the compact disk, i.e. a disk body or blank. Legible matter can be imprinted on the transparent disk and advantageously, that legible matter can extend around the periphery of the transparent disk. The hubs and holes of the two disks may be interconnected by the means enabling relative rotation of the two disks. The transparent disk is, of course, then provided on top of the compact disk which may be imprinted with promotional information, source information, instructive information on the surface outwardly of the hub but opposite the rear mirrored surface of the compact disk, thereby allowing such information to be visible through the transparent disk.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
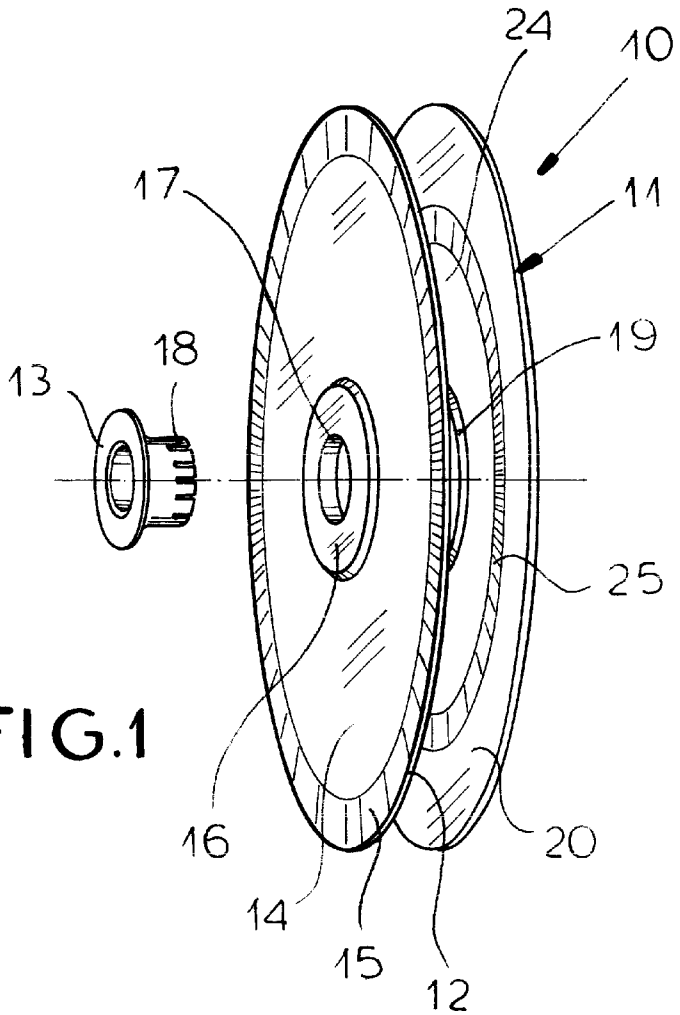
FIG. 1 is an exploded perspective view of a wheel chart illustrating the present invention.

From FIG. 1, it will be apparent that a wheel chart 10 based upon a compact disk 11 can have a transparent disk 12 affixed to the compact disk 11 by a holder 13 enabling relative rotation of the two disks.

The transparent disk 12 is a plastic disk identical to the plastic disk from which the compact disk 11 is made, but without the mirror surface which forms the audio, electronic or optical data carrier of the compact disk.

On the obverse surface 14 of the disk 12, which is transparent, there may be printed indicia 15 allowing the two disks to be used as a wheel chart by rotating the disks relatively and reading information from the two disks and through the transparent disk from the underlying compact disk.

Figure 5:
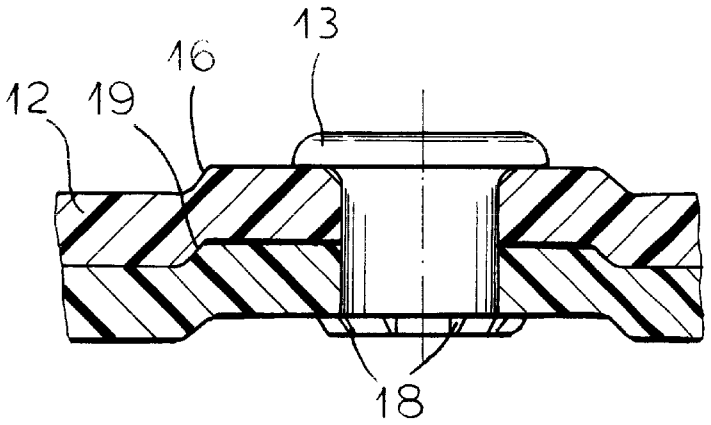
FIG. 5 is an assembled detail of the wheel chart according to the invention.
Figure 4:
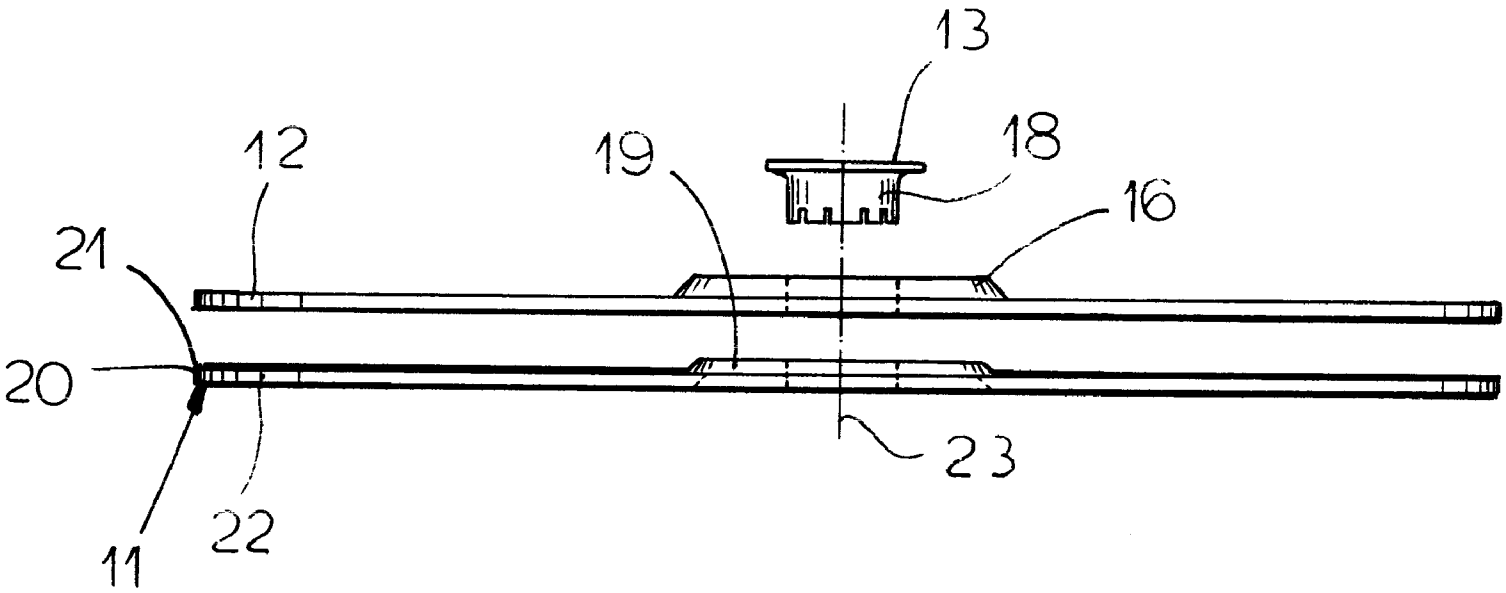
FIG. 4 is an exploded side view of the wheel chart.

The transparent disk has a raised hub portion 16 which also can be seen better in FIGS. 4 and 5. A hole 17 at the center of the hub portion, receives fingers 18 of the holder 13 which can be biased inwardly when the holder is thrust into the hole 17, the tips of the fingers engaging behind the hub portion 19 of the compact disk. The compact disk in turn has on its obverse 20, a layer 21 which is reflective and is the electronic, optical and audio recording layer, the underside of which is exposed through the transparent body of the contact disk from its reverse side 22. The compact disk 11 also has a hole 23 through which the fingers 18 pass and which is coaxial with the hole 17 of the plastic cover disk 12. As can be seen from FIG. 1, the compact disk 11 is opaque and can be imprinted in a central zone 24 with descriptive matter, promotional matter or identifying matter. Outwardly of this central area, it can be provided with other indicia 25 cooperating with the indicia 15 to allow event calculations and the like.

Figure 2:
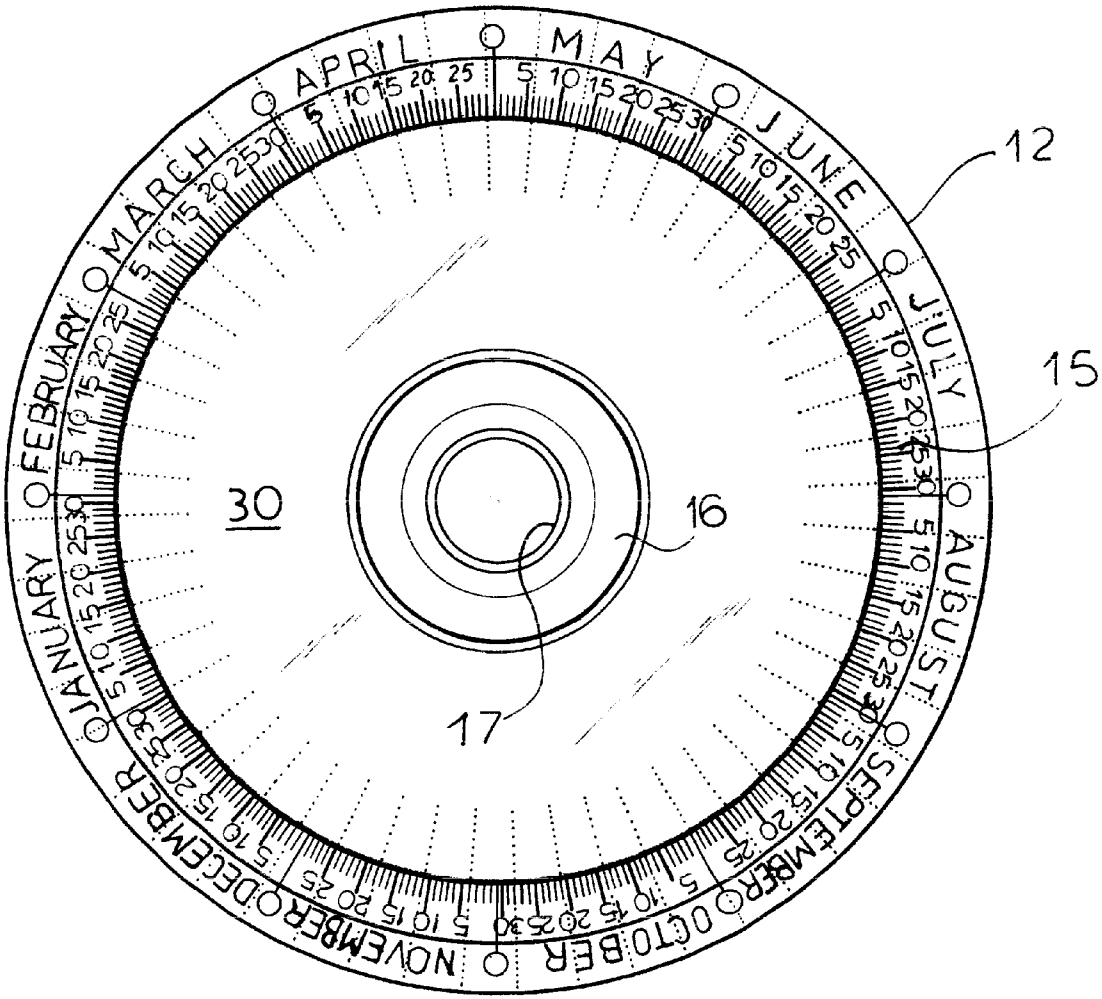
FIG. 2 is a plan view of the transparent disk of that wheel chart.
Figure 3:
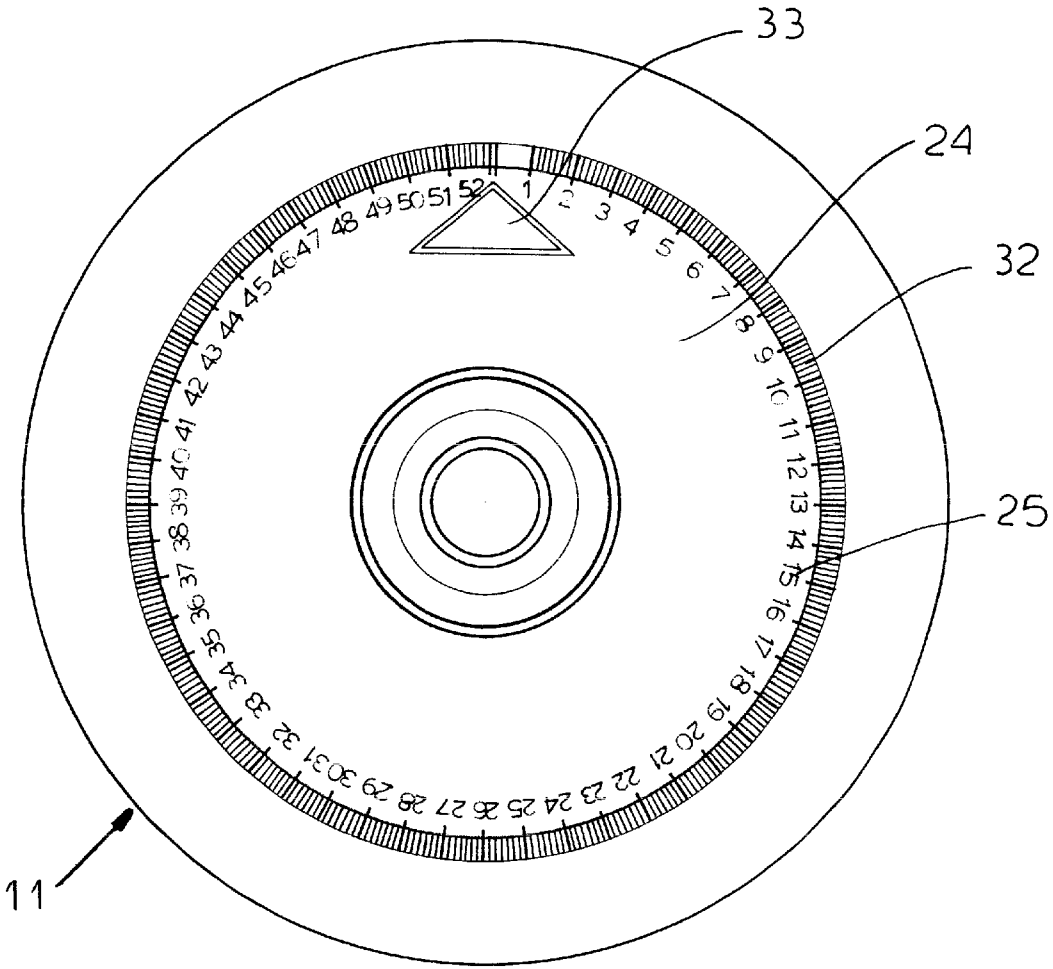
FIG. 3 is a plan view of the compact disk thereof.

For example, the transparent disk 12 as seen in FIG. 2, has the hole 17 and the raised hub portion 16 but is transparent throughout the body of that disk with a zone with a region 30 between the hub 16 and the indicia zone 31 which is completely free from any markings and through which the printed region 24, 25 of the compact disk 11 is visible (compare FIGS. 2 and 3).

In the embodiment shown, which is a delivery date calculator, the number of weeks can be provided on a scale 32 at the boundary of the region 24 and along the scale 25. An arrowhead or printer can be provided at 33. The arrowhead and the scale 32 are visible behind the disk 12 which has, as the scale 15, date markings for each month and a display of the months (FIG. 2).

When the device is assembled so that two disks can be rotated relatively, delivery dates can be calculated. If desired, the device can be pulled apart to allow the compact disk to be played.

We claim:

1. A wheel chart comprising:

a first rigid disk-shaped member having a hub portion and an obverse surface provided with legible matter extending around at least part of said hub portion;

a second rigid disk-shaped member having a hub portion surrounding a hole aligned with the hub portion of said first rigid disk-shaped member, said second rigid disk-shaped member being transparent over at least part of an area positionable over said through said second rigid disk-shaped member, said second rigid disk-shaped member having legible matter correlating with the legible matter of said first rigid disk-shaped member to provide information as to the correlation to a wheel-chart user; and an element rotatably connecting said hub portions for relative rotation of said members and selection of said information by said relative rotation, said members being seperable from one another, at least one of said members being a circular disk formed with a metallization carrying machine reproducible information.

2. The wheel chart defined in claim 1 wherein said one of said members is a compact disk.

3. The wheel chart defined in claim 1 wherein said one of said members is a CD ROM.

4. The wheel chart defined in claim 1 wherein said one of said members is a DVD.

5. The wheel chart defined in claim 1 wherein each of said members is a compact disk and each of said hub portions is formed with a central hole and said element connects said hub portions through said central holes.

6. A wheel chart comprising:

a first rigid disk-shaped member having a hub portion and an obverse surface provided with legible matter extending around at least part of said hub portion;

a second rigid disk-shaped member having a hub portion surrounding a hole aligned with the hub portion of said first rigid disk-shaped member, said second rigid disk-shaped member being transparent over at least part of an area positionable over said legible matter and permitting said legible matter to be viewed through said second rigid disk-shaped member, said second rigid disk-shaped member having legible matter correlating with the legible matter of said first rigid disk-shaped member to provide information as to the correlation to a wheel-chart user; and an element rotatably connecting said hub portions for relative rotation of said members and selection of said information by said relative rotation, at least one of said members being a circular disk formed with a metallization carrying machine reproducible information, said one of said members being said first member and having said metallization over the reverse side thereof.

* * * * *

UNITED STATES PATENT AND TRADEMARK OFFICE

CERTIFICATE OF CORRECTION

PATENT NO. : 6,460,762 B1
DATED : October 8, 2002
INVENTOR(S) : Bromberg

It is certified that error appears in the above-identified patent and that said Letters Patent is hereby corrected as shown below:

Title page,
Item [76], Inventors, delete "Anthony Wilson" as the co-inventor.

Signed and Sealed this

Fourteenth Day of March, 2006

JON W. DUDAS
*Director of the United States Patent and Trademark Office*